US007267425B2

(12) United States Patent
Kawase et al.

(10) Patent No.: US 7,267,425 B2
(45) Date of Patent: Sep. 11, 2007

(54) PRINT CONTROL DEVICE AND PRINT CONTROL METHOD

(75) Inventors: Yuji Kawase, Nagano (JP); Kazuya Toshima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 229 days.

(21) Appl. No.: 10/871,519

(22) Filed: Jun. 21, 2004

(65) Prior Publication Data

US 2005/0099440 A1 May 12, 2005

(30) Foreign Application Priority Data

Jun. 23, 2003 (JP) ..... P2003-178173

(51) Int. Cl.
*B41J 2/21* (2006.01)

(52) U.S. Cl. ..... 347/43; 347/40

(58) Field of Classification Search ..... 347/40–43
See application file for complete search history.

(56) References Cited

U.S. PATENT DOCUMENTS 4,528,576 A 7/1985 Koumura et al.
6,511,144 B2 1/2003 Otsuki
6,597,466 B1 7/2003 Katayama
2002/0070991 A1 6/2002 Otsuki
2003/0025747 A1 * 2/2003 Dinares et al. ..... 347/12

FOREIGN PATENT DOCUMENTS

| | | |
|---|---|---|
| EP | 1 228 881 | 8/2002 |
| EP | 1228881 A2 * | 8/2002 |
| JP | 5-246048 | 9/1993 |
| JP | 11-291556 | 10/1999 |
| JP | 2002-172771 | 6/2002 |
| JP | 2002-172772 | 6/2002 |

* cited by examiner

*Primary Examiner*—Stephen Meier
*Assistant Examiner*—Jason Uhlenhake
(74) *Attorney, Agent, or Firm*—Nixon & Vanderhye P.C.

(57) ABSTRACT

A print control device includes a two-step print head, a print data assignment control section and a transportation control section. The two-step print head includes a plurality of printing elements of plural colors for performing color printing. The printing elements are divided into upper printing elements and lower printing elements for each different color separated by a boundary line. The print data assignment control section assigns print data of each color to the upper printing elements and the lower printing elements beginning adjacent the boundary line. The transportation control section controls a transportation amount of a printing medium in accordance with the number of the printing elements to which the print data is assigned.

5 Claims, 15 Drawing Sheets

PRINT CONTROL DEVICE AND PRINT CONTROL METHOD

BACKGROUND OF THE INVENTION

The present invention relates to a print control device for color print and a printing method, and particularly to a print control device and print control method in which printing is performed by a two-step print head which has printing elements of each color for color print, each row of the printing elements being arranged in a longitudinal direction of the print head.

In color print by a printer (printing apparatus), various colors are expressed by combination of cyan (C), magenta (M), yellow (Y), and the like. As a color used for a character, black (K) is also used. Therefore, a print head includes printing elements for printing these colors. Though there is also a printer which includes elements for other colors than these colors, since the basic principle is the same, the description in this specification is performed using these four colors.

For example, in an ink jet printer, in order to eject these four kinds of ink, four kinds of ink ejection nozzles directed to each color of CYMK are required. There are print heads in which ejection nozzles for each color of CYMK are provided line by line longitudinally, and a print head in which ejection nozzles are provided in an upper area and a lower area so that the upper area and the lower area have two colors respectively (referred to as a two-step print head). The print head is mounted on a carriage moving transversely, and when the carriage moves on a printing paper traversely, the ejection nozzles of the print head mounted on the carriage eject necessary ink onto the printing paper so that color printing is performed.

For example, in a print head in which ejection nozzles for each color of CYMK are provided line by line longitudinally, that is, four rows of ejection nozzles are provided in total, when the print head traverses the printing paper once (referred to as a "print pass" where the carriage thus traverses the printing paper), the ejection nozzles for all the colors pass through the same position of the printing paper. Therefore, by one print pass, color printing is completed.

However, in the two-step print head in which the ejection nozzles for CYMK are provided in the upper area and the lower area so that the upper area and the lower area have two colors respectively, the ejection nozzles for all the colors of CYMK cannot pass through the same position of the printing paper. Therefore, in order to print the four color data, a print pass for printing by upper-step printing elements and a print pass for printing by lower-step printing elements are required (two print passes are required in total).

FIG. 15A shows an example of a two-step print head 70. In the two-step print head 70 shown in FIG. 15A, a nozzle group 71 of C-color and a nozzle group 72 of Y-color (lower-step nozzle groups) are arranged on the lower step side of the two-step print head longitudinally, and each nozzle group includes 32 nozzles. A nozzle group 73 of K-color and a nozzle group 74 of M-color (upper-step nozzle groups) are arranged on the upper step side longitudinally, and each nozzle group includes 32 nozzles. FIG. 15B shows a printing process (print pass) for a color print by the two-step print head 70 in the related art.

When a printing paper 81 moves from the downside to the upper side (the print head moves from the upside to the downside: in a Y1-direction), in order to complete the color printing of the height corresponding to 32 picture elements, in a first print pass (1), first C-color printing and Y-color printing are performed by the lower-step nozzle groups. Next, after the printing paper has been moved so that the upper-step nozzle groups pass through the same position as the position in the first print pass, in a second print pass (2), K-color printing and M-color printing are performed by the upper-step nozzle groups. In this second print pass (2), the lower-step nozzle groups execute a first print pass for printing the next print data. Thus, by the two print passes, printing for all the colors of CYMK is completed (The print pass in which printing is completed is shown by oblique lines in the upper step of the two-step print head 70). When the two print passes are thus executed, the print data are assigned to both of the upper-step nozzle groups and the lower-step nozzle groups.

Further, in a related art, print data hear the page end is printed by the printing element located upward of the original printing element thereby to prevent a platen from being stained with the ejected ink (refer to JP-A-2002-172771 and JP-A-2002-172772).

However, the print data are assigned to both of the upper-step printing elements and the lower-step printing elements in order from the upper side printing element, and when the print data near the page end is printed by the upper-step printing elements, the printing paper must be fed near the upper end of the upper-step printing elements (refer to a last print pass "L" in FIG. 15B). By this paper feeding, the lower-step printing elements can move to the upper side of a print starting position of a next print page 82. In this case, in order to print the print data of the next print page 82 by the lower-step printing elements of the two-step printing head correctly, after the printing paper has been transported in the opposite direction (Y2-direction), printing of the next printing page 82 must be started. Transportation in the opposite direction (reverse feeding) not only makes a paper feeding mechanism complicated but also causes deterioration of print quality due to delay of print speed and backlash.

SUMMARY OF THE INVENTION

It is therefore an object of the present invention to provide a print control device and print control method of a two-step print in which printing can be performed efficiently without feeding the printing paper in the reverse direction.

Further, it is another object of the invention to provide. a print control device and print control method in which print control of a two-step print head can be simply performed.

In the invention, by controlling printing of print data on the basis of the divided position of the two-step print head which is divided into upper and lower two steps, the above problems are solved.

(1). A print control device, comprising:

a two-step print head including a plurality of printing elements of plural colors for performing color printing, the printing elements being divided into upper printing elements and lower printing elements for each different color separated by a boundary line;

a print data assignment control section which assigns print data of each respective color to the upper printing elements beginning adjacent the boundary line and the lower printing elements beginning adjacent the boundary line; and a transportation control section which controls a transportation amount of a printing medium in accordance with a number of the printing elements to which the print data is assigned.

In the above configuration, since the print data is assigned on the basis of a divided position, when printing in the last print pass of one page is performed by the upper printing elements, printing of the last dot line in the page is performed by the lowest printing element. Accordingly, when printing of one page ends, the center (divided position) portion of the two-step print head is located at the page boundary, and printing of the next page can be instantly started without requiring the printing medium to be fed in reverse.

(2). The print control device according to (1), wherein the print data assignment control section assigns the print data of each color for one page to the printing elements of plural colors in order by a number of the printing elements of the two-step print head; and wherein the print data assignment control section assigns residual print data to the printing elements arranged near the boundary line, a size of the residual print data being smaller than a span of the printing elements of the two-step print head in the number.

In the above configuration, using all the printing elements of the two-step printing head, printing is executed. Therefore, the number of printing passes necessary to complete printing of one page is minimized, so that a print speed can be accelerated.

(3) The print control device according to (2), wherein the transportation control section transports the printing medium by a length corresponding to each of the upper printing elements and the lower printing elements; and wherein when the residual print data is printed by the upper printing elements, the transportation control section transports the printing medium by a distance corresponding to a length of the upper printing elements to which the residual print data is assigned. Transportation of the printing medium can thus be adjusted to printing by all the printing elements and printing of the last print pass.

(4). The print control device according to (1), wherein the print data assignment control section calculates a greatest common divisor which is smaller than the number of the printing elements in a direction perpendicular to a scanning direction of the two-step print head, and the number of print picture elements in the longitudinal direction of one page print data is uniformly divisible by the greatest common divisor; and wherein the print data assignment control section assigns the print data to a number of the upper printing elements and the lower printing elements, corresponding to the number of the greatest common divisor, beginning from the boundary line of the two-step, print head. In the last print pass, printing can be executed, similar to the processing in another print pass, so that the control method is easy. Further, since all the print width is the same, high print quality can be obtained with an interlaced printing type.

(5). The print control device according to (4), wherein the transportation control section transports the printing medium by a length corresponding to the number of the greatest common divisor. The transportation of the printing medium is controlled to the print pass of a uniform width.

(6). A print control method of a printing apparatus with a two-step print head including a plurality of printing elements of plural colors for performing color printing, the printing elements being divided into upper printing elements and lower printing elements for each different color separated by a boundary line, the print control method comprising:

(a) assigning print data of each color to the upper printing elements and the lower printing elements of the two-step print head beginning adjacent the boundary line; and (b) controlling a transportation amount of a printing medium in accordance with the number of the printing elements to which the print data is assigned.

(7). The print control method according to (6) wherein in step (a); the print data of each color for one page is assigned to the printing elements of plural colors in order by a number of the printing elements of the two-step print head; and wherein in the step (a), residual print data is assigned to the printing elements arranged near the boundary line, a size of the residual print data being smaller than a span of the printing elements.

(8). The print control method according to (6), wherein in step (b), the printing medium is transported by a length corresponding to each of the upper printing elements and the lower printing elements; and wherein in the step (b), when the residual print data is printed by the upper printing elements, the printing medium is transported by a distance corresponding to a length of the upper printing elements to which the residual print data is assigned.

(9). The print control method according to (6), wherein in step (a), a greatest common divisor which is smaller than a number of the printing elements in a direction perpendicular to a scanning direction of the two-step print head is calculated, and a number of print picture elements in the longitudinal direction of one page print data is uniformly divisible by the greatest common divisor; and wherein in the step (a), the print data is assigned to a number of the upper printing elements and the lower printing elements, corresponding to the number of the greatest common divisor, beginning from the boundary line of the two-step print head.

(10). The print control method according to (9), wherein in step (b), the printing medium is transported by a length corresponding to the number of the greatest common divisor.

(11). A recording medium which has a program that causes a computer to execute each step in the method according to (6), and which can be read by a computer. The computer comprises a CPU, a logic circuit, a memory, and various control programs. By reading this program, each step in the above method is executed.

(12). A print control device for performing color printing on a printing medium, the print control device comprising:

a color print head including a plurality of printing elements divided by color into upper printing elements and lower printing elements separated by a boundary line, a first through last of the upper printing elements defining an upper printing element span, and a first through last of the lower printing elements defining a lower printing element span, wherein the first upper printing element is disposed adjacent the boundary line on one side thereof, and wherein the first lower printing element is disposed adjacent the boundary line on a opposite side thereof;

a print data assignment control section which assigns print data to the upper and lower printing elements, wherein when a print area of the print data has a printed dimension less than the upper or lower printing element span, the print data assignment control section assigns print data beginning with the first upper or lower printing element; and a transportation control section which controls a transportation amount of the printing medium by a distance corresponding to a number of the printing elements to which the print data is assigned.

As described above, on the basis of the divided position of the two-step print head divided into the upper and lower two steps, printing of print data for each color is controlled. Thus, when one page printing ends, the center (divided position) part of the two-step print head is arranged at the page boundary, and printing of the next page can be immediately started by the lower-step printing elements. Further, by controlling one page printing by a print pass of uniform width, all the print passes can be processed by the same control, so that control becomes easy. Further, with the print control of uniform width, interlaced type printing can be adopted, so that high print quality can be obtained.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1B:
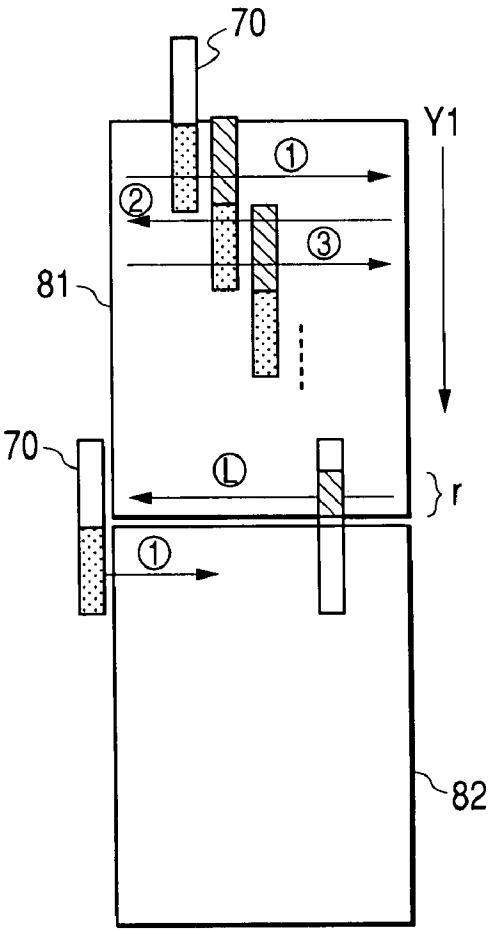
FIGS. 1A and 1B show diagrams for explaining print control of a two-step print head according to a first embodiment of the invention.
Figure 1A:
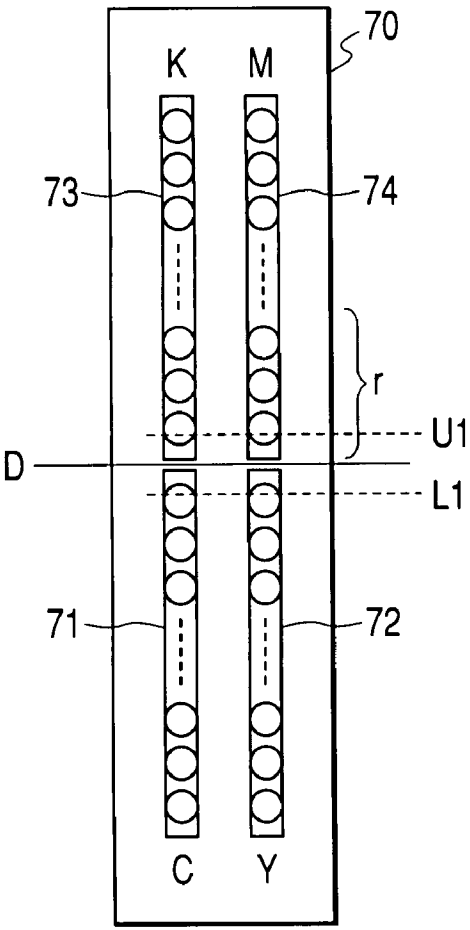

Embodiments of the invention will be described below with reference to drawings. FIGS. 1A and 1B are diagrams for explaining print control of a two-step print head according to a first embodiment of the invention. In this embodiment, on the basis of a divided position (boundary position) D of a two-step print head 70, print data for each color is assigned to printing elements (nozzles) for printing. To assign the print data on the basis of the divided position D means to assign the print data, with the divided position D of the upper-step and lower-step printing elements as a center, to the lower-step printing elements from the upper side to the lower side and to the upper-step printing elements from the lower side to the upper side.

More specifically, when the print data is assigned to the C and Y-printing nozzles of the lower-step printing elements, on the basis of a first nozzle L1 in the lower-step nozzle group closest to the divided position, the print data corresponding to the print pass is assigned in order from the upper nozzle (printing element) to the lower nozzle (printing element). When the print data is assigned to the upper-step nozzle group, on the basis of a nozzle U1 in the upper-step nozzle group closest to the divided position, the print data corresponding to the print pass is assigned in order from the lower nozzle (printing element) to the upper nozzle (printing element).

By thus assigning the print data on the basis of the divided-position D, as shown in FIG. 1B, in print by the last print pass ("L"), the residual data (height "r") is printed on the basis of the lowest part of the upper-step printing elements. Therefore, when printing by the last print pass ("L") ends, the lower-step nozzle group is located in a position of a first print pass (1) of the next print page, so that it is not necessary to feed the printing paper in the reverse direction unlike the related art.

Figure 2:
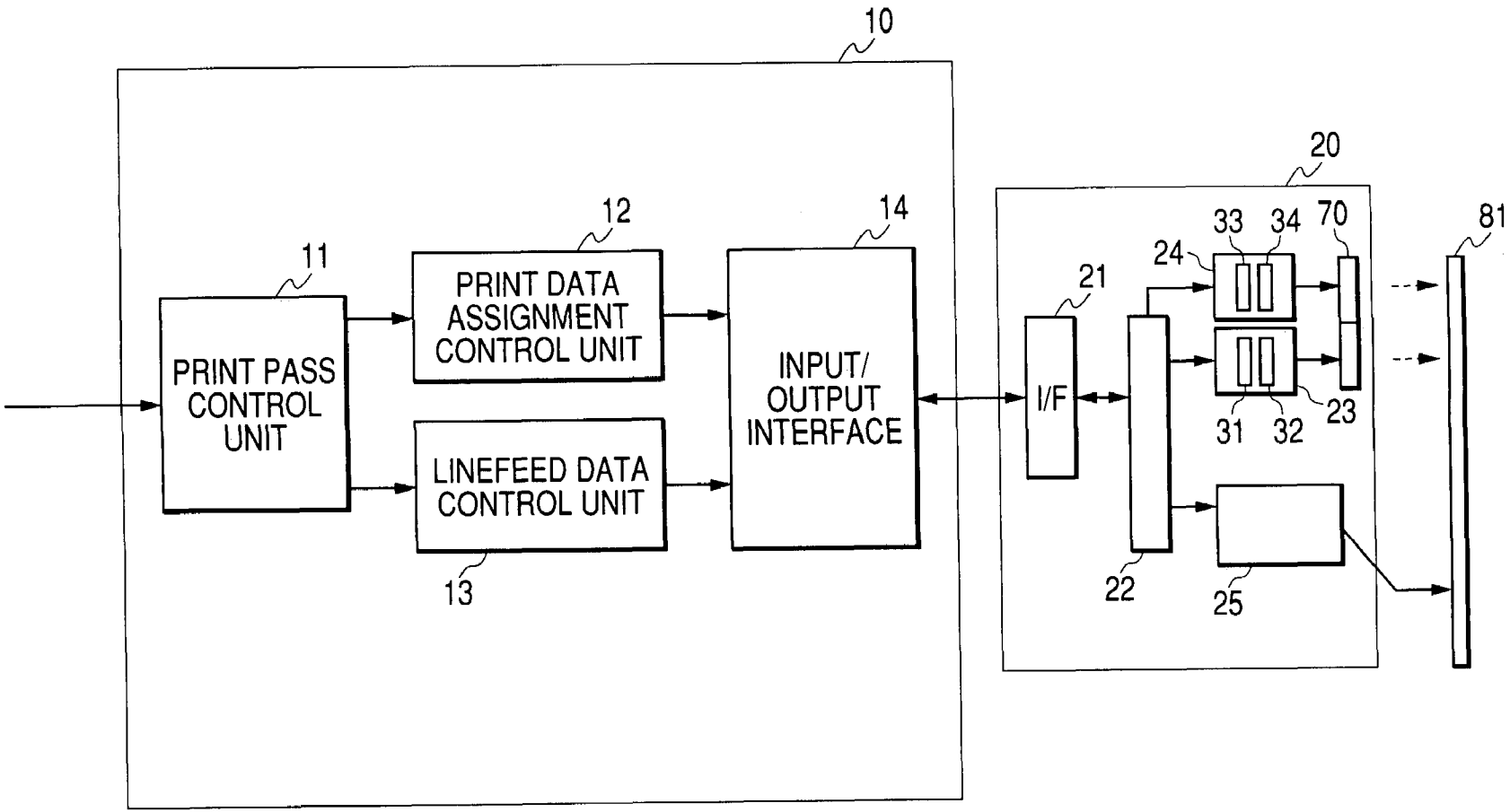
FIG. 2 shows a function block diagram showing a print control device for executing printing by the two-step print head according to the first embodiment of the invention and a printing apparatus.

FIG. 2 shows the print control device for performing printing by the two-step print head. A print control device 10 is installed in a print driver in a host apparatus. The print control device 10 includes a print pass control unit 11, a print data assignment control unit 12, and a linefeed data control unit 13. Print data and linefeed data are output through an input/output interface 14 to a printing apparatus 20 having a two-step print head 70.

Upon reception of print data of one page, the print pass control unit 11 calculates how many print passes are required for one page printing based on the number of printing elements of the two-step print head 70 and the number of print dots in the longitudinal direction of one page. When the number of print passes is determined, the print data assignment control unit 12 outputs the print data of each color in each print pass. The linefeed data control unit 13, every time each print pass ends, moves printing paper 81, and outputs transportation data and a movement control command so that the two-step print head 70 is moved downward relatively to the printing paper 81.

The print data transmitted to the printing apparatus 20 through the input/output interface 14 is input through an interface 21 to a control section 22. The control section 22 inputs the print data to an upper-step print buffer 24 and a lower-step print buffer 23 in order to assign the print data for each color to the corresponding printing elements. Each print buffer 23, 24 has buffers 31 to 34 for each color. In the first print pass, the data of the lower-step print buffer 23 is printed with colors (C, Y) of the lower-step printing elements.

When printing of the first print pass is performed, the linefeed data is input to a transportation control section 25, and linefeed (paper feeding) of the printing paper 81 is performed by the width of the print pass. When linefeed of the printing paper is completed, printing by a second print pass is performed. In the second print pass, printing is performed with colors (K, M) of the upper-step printing elements and the colors (C, Y) of the lower-step printing elements.

Figure 3:
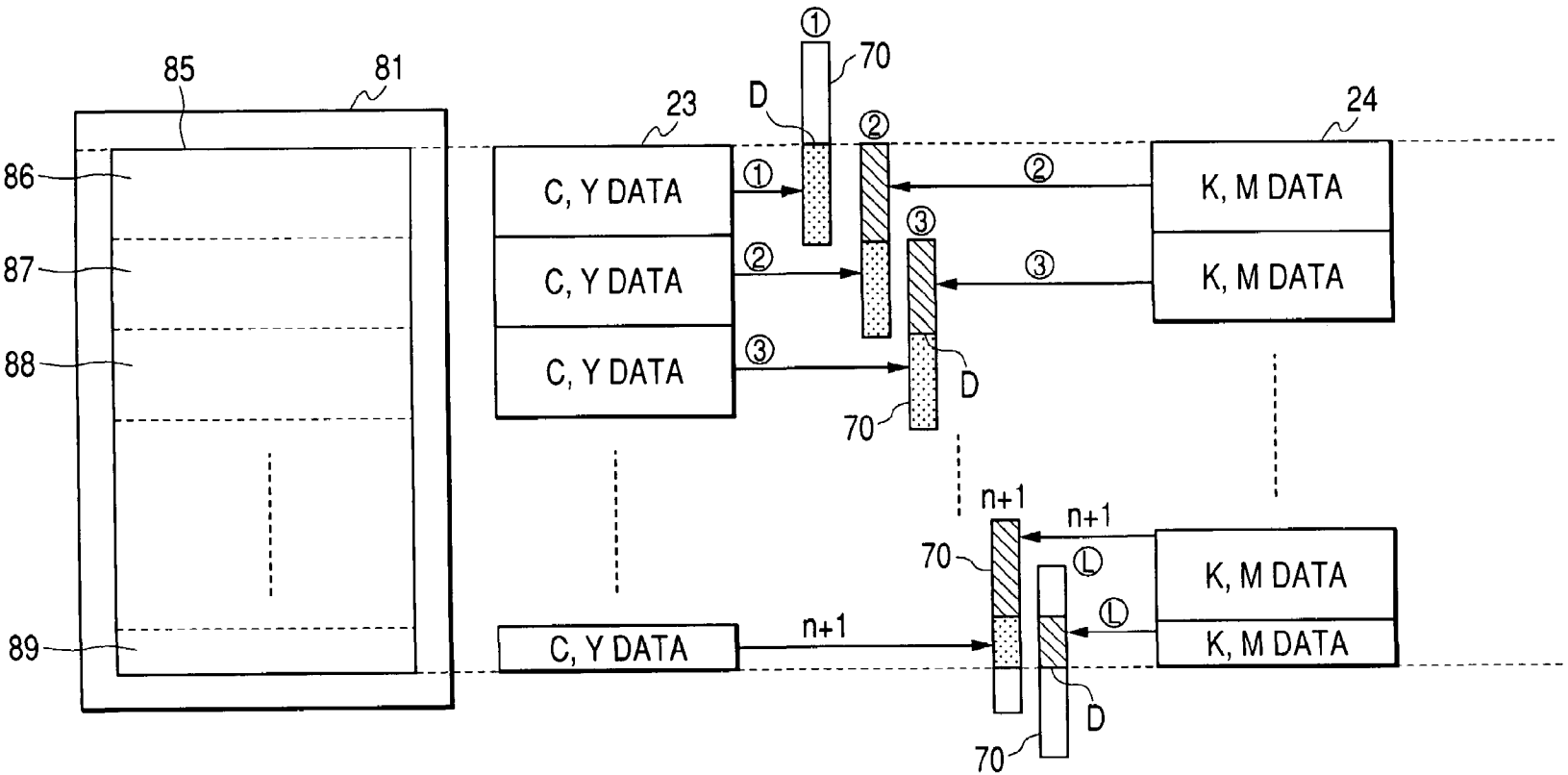
FIG. 3 shows a schematic diagram for explaining a relation between each print pass of print control according to the first embodiment of the invention and print data.

With reference to FIG. 3, a relation between each print pass and the print data will be described. Color printing 85 is performed on the printing paper 81. The color printing 85 is performed by repeating printing of the print data 86 to 89 in each print pass. Each print data 86 to 89 includes each color data of C, Y, K, and M. In a first print pass (1), C-color printing and Y-color printing are performed by the lower-step printing elements 71 and 72. Therefore, in the first print pass (1), C-color print data and Y-color print data are output from the lower-step print buffer 23 to the lower-step printing elements 71 and 72.

In a second print pass (2), K-color print data and M-color print data are assigned to the upper-step printing elements 73 and 74, and printing is performed by the upper-step printing elements 73 and 74. By completion of this printing by the upper-step printing elements 73 and 74, color printing of the print data 86 with C, Y, K, and M-colors is completed. In the second print pass (2), C-color printing and Y-color printing of a next print data 87 are performed by the lower-step printing elements 71 and 72. Similarly, in a third print pass (3), K-color printing and M-color printing for the print data 87 are performed by the upper-step printing elements 73 and 74, and color printing of the print data 87 is completed.

As the printing process is thus repeated, print data 89 of a fraction that cannot be divided by the number of the printing elements remains. When a total number of dots in one page is divided by the number of nozzles in the longitudinal direction in a longitudinal type head to get n and a remainder (r), when the whole of the longitudinal type head 70 is reciprocatively moved n-times in printing, r dots of the fraction remain. Actually, since printing is started by the lower-step printing elements 71 and 72 and it is ended by the upper-step printing, elements 73 and 74, the two-step print head 70 traverses the printing paper n+2 times to complete printing of one page.

C-color printing and Y-color printing of the fractional print data (r dots) are performed in the second pass (n+1) from the last by the lower-step printing elements 71 and 72. At this time, the nozzles used in printing by the lower-step printing elements 71 and 72 are lower nozzles sequential to the L1. When the second pass (n+1) from the last ends is completed, in the last print pass (L=n+2), K-color printing and M-color printing are performed by the upper-step printing elements 73 and 74. The fractional print data 89 assigned to the upper-step printing elements 73 and 74 in the last print pass (L) is assigned to the upper side printing elements in order from the U1 on the basis of the divided position D. Therefore, as shown in FIG. 3, the printing paper 81 is transported so that the divided position D is located at the lowest part of the print data 89, and the last print pass (L) is executed. In the last print pass (L), the residual print data 89 of K-color and M-color is assigned to the upward printing elements on the basis of the divided position D. By ending of the last pass, all printing is completed. Therefore, the next printing can be performed without feeding the printing paper in the reverse direction.

Figure 4:
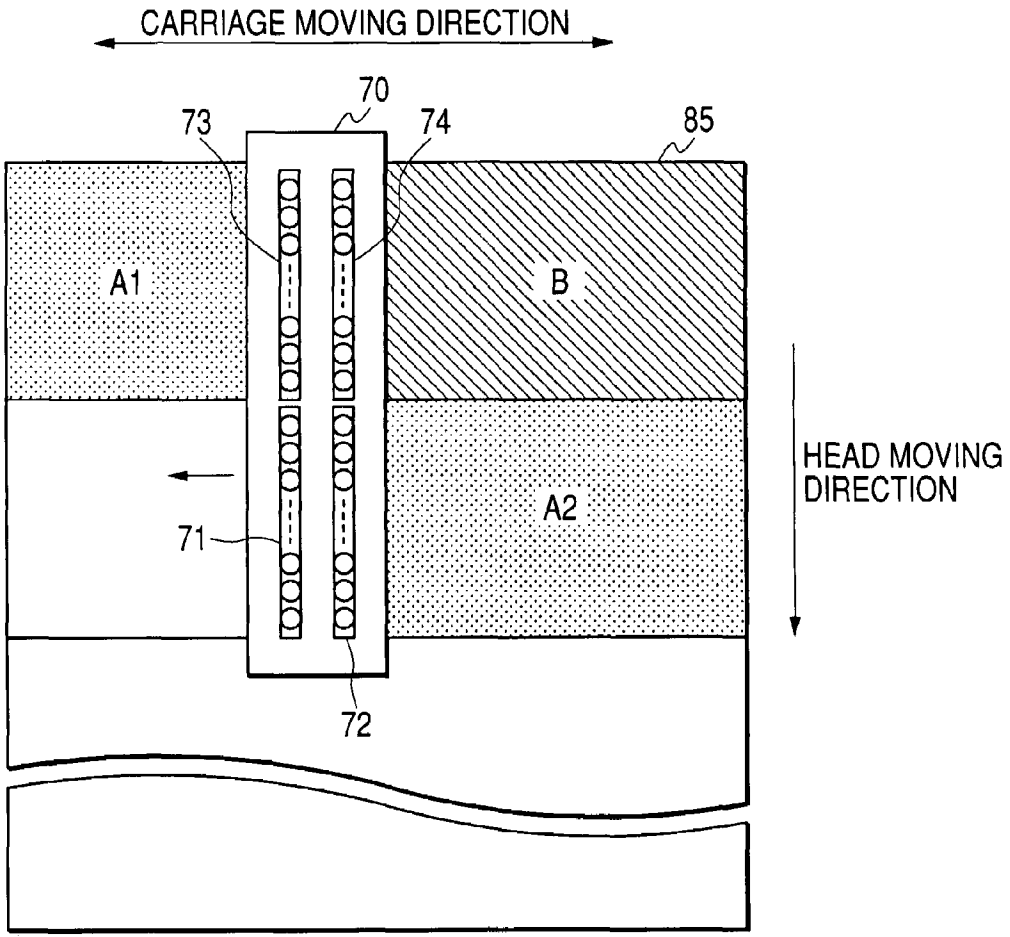
FIG. 4 shows a diagram for explaining a condition where color printing is performed by upper and lower printing elements.

FIG. 4 is a diagram for explaining a condition in which color printing is performed by the upper-step and lower-step printing elements. The condition shows the print head moved on the way of the second print pass after printing has been completed by the lower-step printing elements of the print head in the first print pass. A portion shown by a fine dot pattern shows a portion where C-color printing and Y-color printing have been completed by the lower-step printing elements 71 and 72. A portion A1 shows a portion where printing has been completed by the first print pass, and a portion A2 shows a portion where printing has been completed by the second print pass. A portion B shown by oblique lines is a portion where K-color printing and M-color printing have been completed by the upper-step printing elements in the second print pass (that is, a portion where printing has been performed using all the colors of C, Y, K, and M, and color printing has been completed).

(Description of Print Control Procedure)

Next, a print control procedure will be described using a flowchart.

Figure 5:
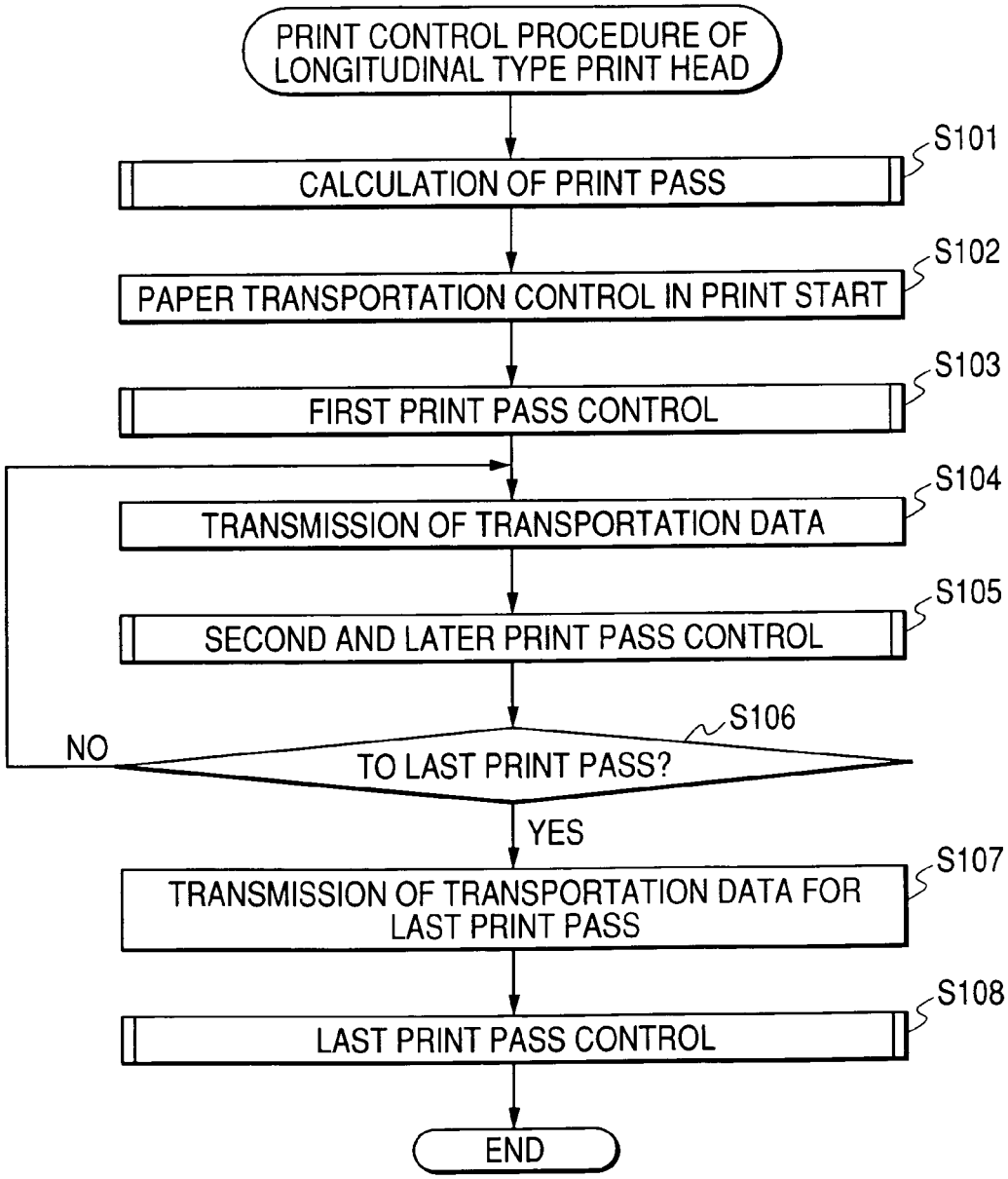
FIG. 5 shows a flowchart showing color print control procedure of the two-step print head according to the first embodiment of the invention.

FIG. 5 is a flowchart showing a color print control procedure of the two-step print head according to the first embodiment of the invention. First, the number of print passes necessary to print one page is calculated (S101). Next, in order to match the position of each nozzle of the lower-step printing elements to a print starting position, the printing paper is transported to the divided position D of the two-step print head 70 (S102). Thereafter, control for executing the first print pass is performed (S103).

When the first print pass ends, in order to execute the next (second) print pass, the printing paper is transported by the distance calculated in the calculation step of S101 (S104). Thereafter, control for executing the second print pass is performed (S105). Next, whether the procedure proceeds to the last print pass is confirmed (S106). Since the total print pass number is found by the print pass calculation in step S101, by counting the print pass number every time the procedure passes through the confirmation step S106, whether the procedure proceeds to the last print pass can be judged. When the next print pass is not the last print pass (S106, NO), transmission of the transportation data (S104) and execution control (S105) of the second and later print passes are repeated, and printing by the print pass is performed in order. When the next print pass is the last print pass (S106, YES), the printing paper is transported by the distance corresponding to the last print pass calculated in step S101 (S107), and printing by the last print pass is performed (S108).

The above print pass calculation (S101), the first print pass control (S103), the second and later print pass control (S105), and the last print pass control (S108) will be described in detail.

(Print Pass Calculation)

Figure 6:
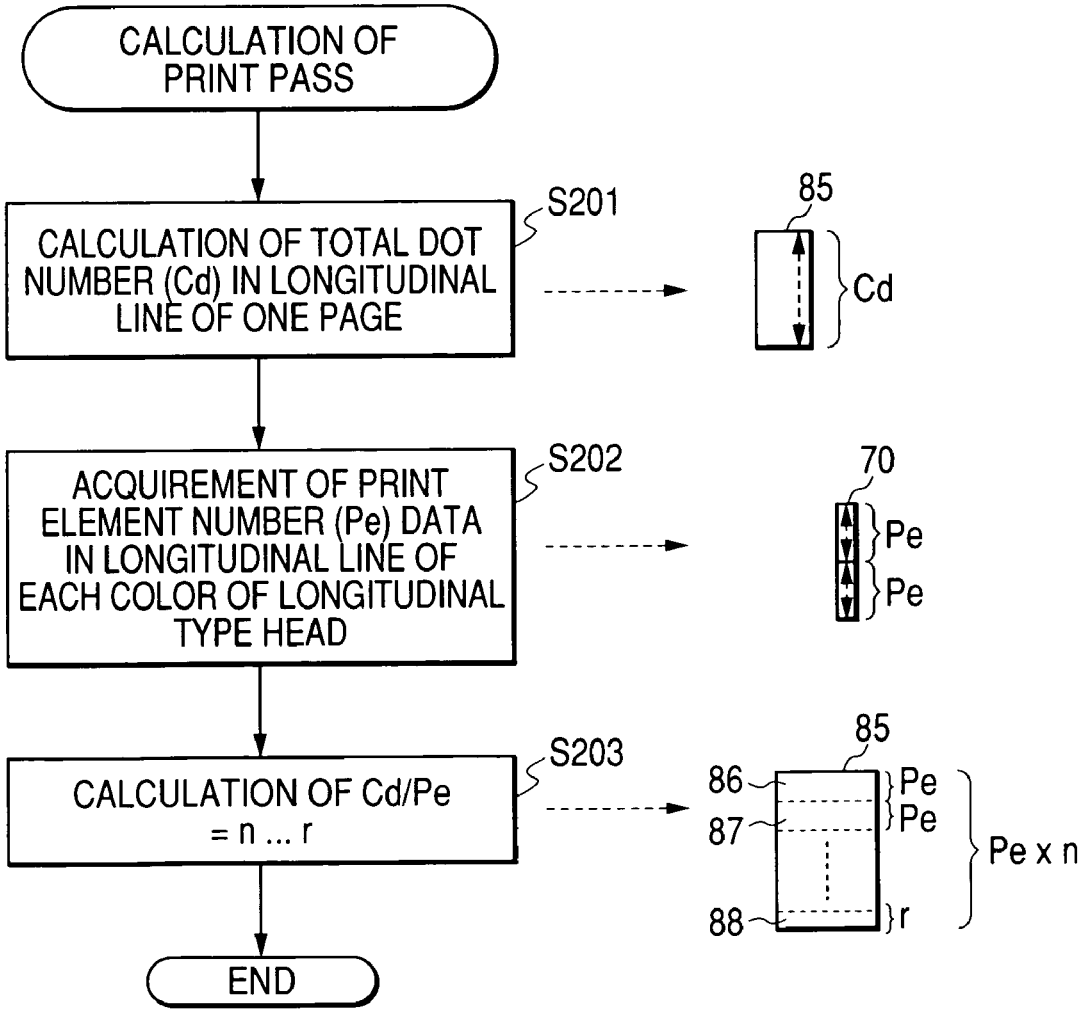
FIG. 6 shows a flowchart showing calculation of print pass in the first embodiment of the invention.

With reference to FIG. 6, the print pass calculation (step S101 in FIG. 5) will be described. In the print pass calculation, first the total number Cd of print dots in the longitudinal direction necessary for printing of data of a page 85 is determined (S201). When a size of one page and print resolution are constant, the total number Cd may be previously calculated and stored. Next, the number Pe of the printing elements of the two-step print head 70 is read out from a memory region (S202), and on the basis of the calculated total number Cd and the read-out number Pe, the print pass number is calculated by the following expression: Cd/Pe=n+the remainder (r) (S203). When color printing is performed using all the printing elements, it is found that the number of the print passes necessary for color printing of one page is n+2 (because a print pass for printing print data of r-number which is not divided by Pe and the last print pass by the upper-step printing elements are added).

(Control Procedure of First Print Pass)

Figure 7:
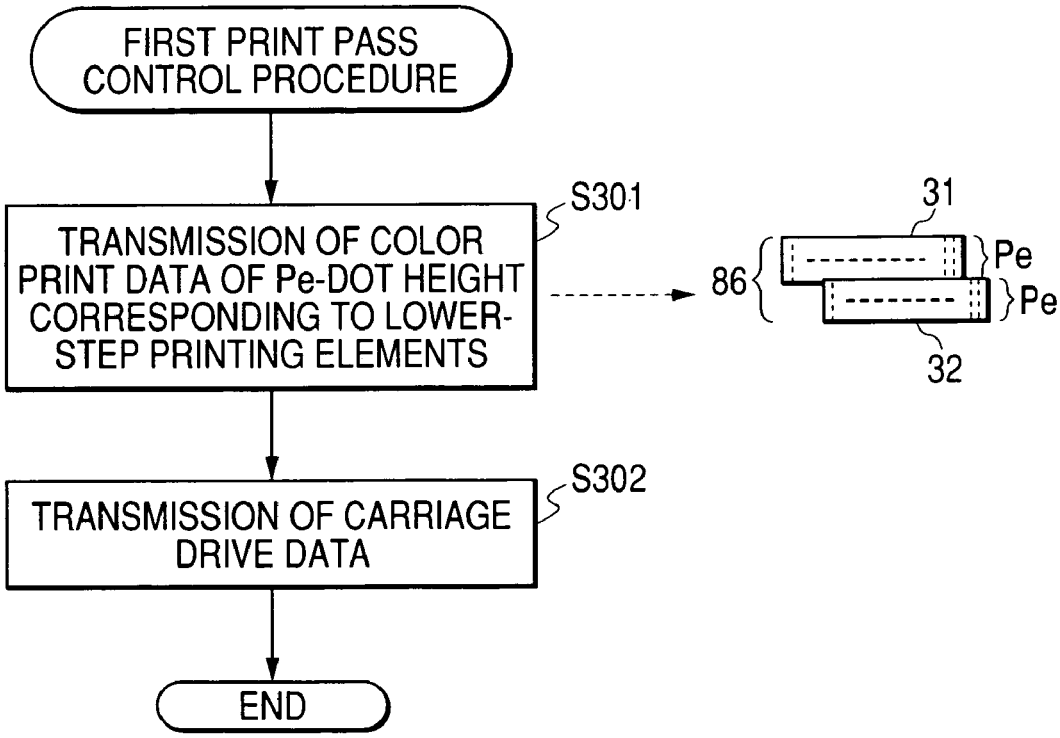
FIG. 7 shows a flowchart showing print control procedure of a first print pass according to the first embodiment of the invention.

With reference to FIG. 7, the print control procedure of the first print pass (step S103 in FIG. 5) will be described. FIG. 7 is a flowchart showing the print control procedure of the first print pass according to the first embodiment of the invention. In the first print pass, by the lower-step printing elements 71 and 72, C-color data and Y-color data in the first print data 86 are printed. Therefore, the C-color print data of the longitudinal width Pe and the Y-color print data of the longitudinal width Pe are transmitted to the printing apparatus 20, and stored into the respective print buffers 31 and 32 (S301). The print data stored into the print buffers 31 and 32 are output to the lower-step printing elements 71 and 72 in order in synchronization with the movement of the carriage, and printing is performed. Drive in the transverse direction of the carriage can be controlled so as to perform in a transverse direction in a range necessary for printing of the print data by the print pass during execution and the next print pass, and carriage drive control data is transmitted accordingly (S302).

(Control Procedure of Second and Later Print Passes)

Figure 8:
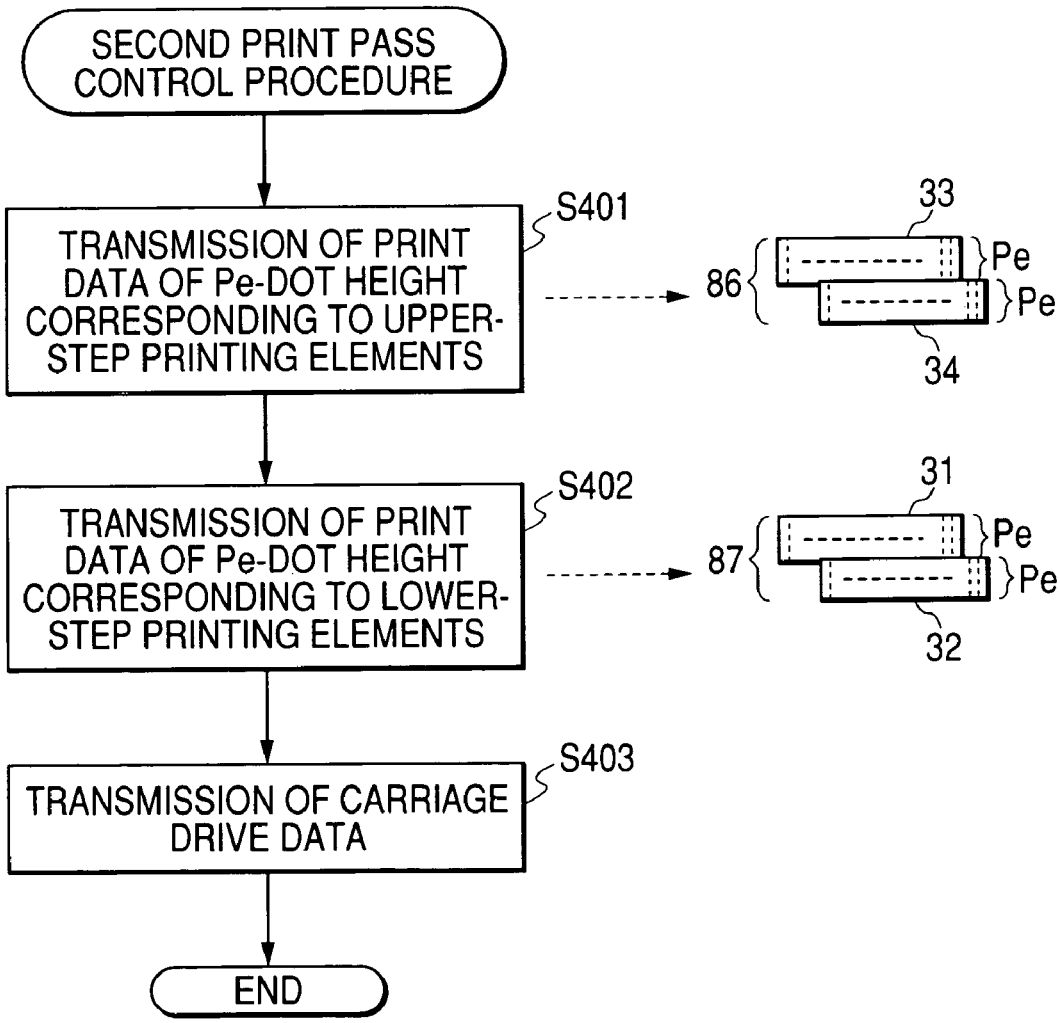
FIG. 8 shows a flowchart showing control procedure of a second print pass according to the first embodiment of the invention.

The control procedure of second and later print passes will be described. FIG. 8 is a flowchart showing the control procedure of the second print pass according to the first embodiment. In the second print pass, K-color data and M-color data of the first print data 86 are printed by the upper-step printing elements 73 and 74, and C-color data and Y-color data of the second print data 87 are printed by the lower-step printing elements 71 and 72. Therefore, the K-color data and the M-color data of the print data 86 are transmitted to the printing apparatus 20 (S401), and stored into the respective print buffers 33 and 34.

Further, the C-color data and the Y-color data of the print data 87 are transmitted to the printing apparatus 20 (S402), and stored into the respective print buffers 31 and 32. Next, the control data for driving the carriage is transmitted (S403). The print data stored into each print buffer 31 to 34 is output to the corresponding nozzle of each printing element 71 to 74 in order in synchronization with the movement of the carriage, and ink is ejected from the corresponding nozzle.

(Transportation and Print Control Procedure of Last Print Pass)

Figure 9:
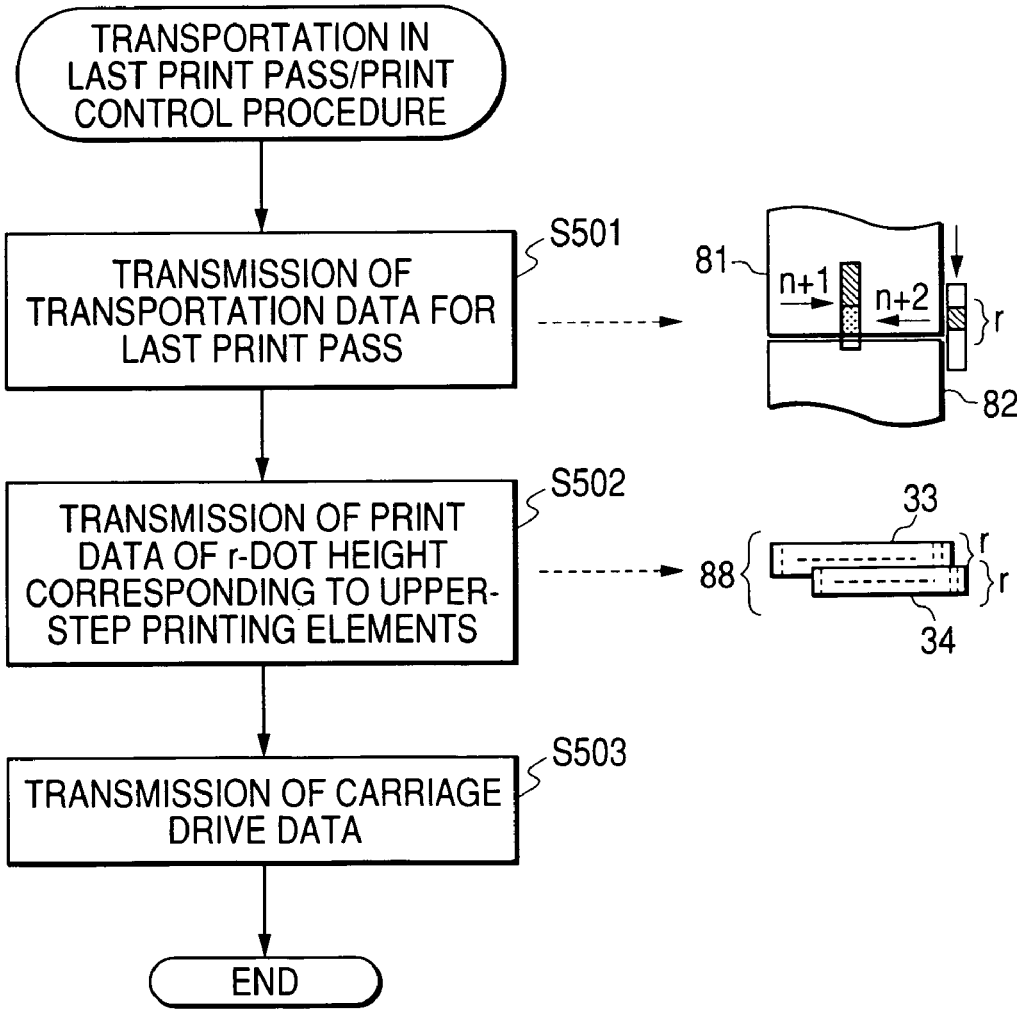
FIG. 9 shows a flowchart showing an example of control procedure of the last print pass according to the first embodiment of the invention.

With reference to FIG. 9, the print control procedure in the last print pass (steps S107 and S108 in FIG. 5) will be described. FIG. 9 is a flowchart showing the control procedure of the last print pass according to the first embodiment of the invention. In the n+1st print pass, the lower printing elements print the fractional print data 89. Therefore, using only the nozzles of the lower-step printing elements close to the divided position D, the C-color data and the Y-color data of the fractional print data 89 are printed. In the last print pass (the n+2nd print pass), the K-color data and the M-color data of the fractional print data 89 including the r-dots in the longitudinal width are printed using the nozzles of the upper-step printing elements 73 and 74 near the divided position D. Printing of one page including the fractional print data 89 is thus completed.

When the n+1st print pass ends, in order to execute the last print pass (the n+2nd print pass), transportation of the printing paper is performed (S501). In printing by the last print pass, the fractional print data 89 is printed by the renumber upper-step printing elements from the divided position D. Therefore, the printing paper is controlled so as to be transported by the distance of the r-number. Next, the K-color print data and the M-color print data (each height: r-dots) of the print data 89 are transmitted to the printing apparatus 20 (S502) and stored respectively into the print buffers 33 and 34. Thereafter, the control data for driving the carriage is transmitted (S503). The print data stored into each print buffer 33, 34 is output to the corresponding nozzle of each printing element 73 to 74 in order in synchronization with the movement of the carriage. Ink according to the print data is ejected from the corresponding nozzle, and printing is completed.

As described above, in the last print pass, by the upper printing elements located near the divided position D of the two-step print head 70, the fractional (residual) print data 89 is printed. Accordingly, when the last print pass ends, the lower-step printing elements 71 and 72 of the two-step print head 70 are located in the print starting position of the next page. Therefore, also in a case of successive printing paper such as roll paper, printing of the next page can be started without feeding the paper in the reverse direction.

(Second Embodiment of the Invention)

A second embodiment of the invention will be described. In the second embodiment of the invention, each print pass of equal width (longitudinal length) is repeated to thereby end all printing of one page. Processing of the fractional print data like the last print pass in the first embodiment is not required, so that simple print control can be performed. Further, since the print pass of equal width is executed throughout the entirety of one page, when interlaced type printing is adopted, print quality can be kept high.

Figure 10:
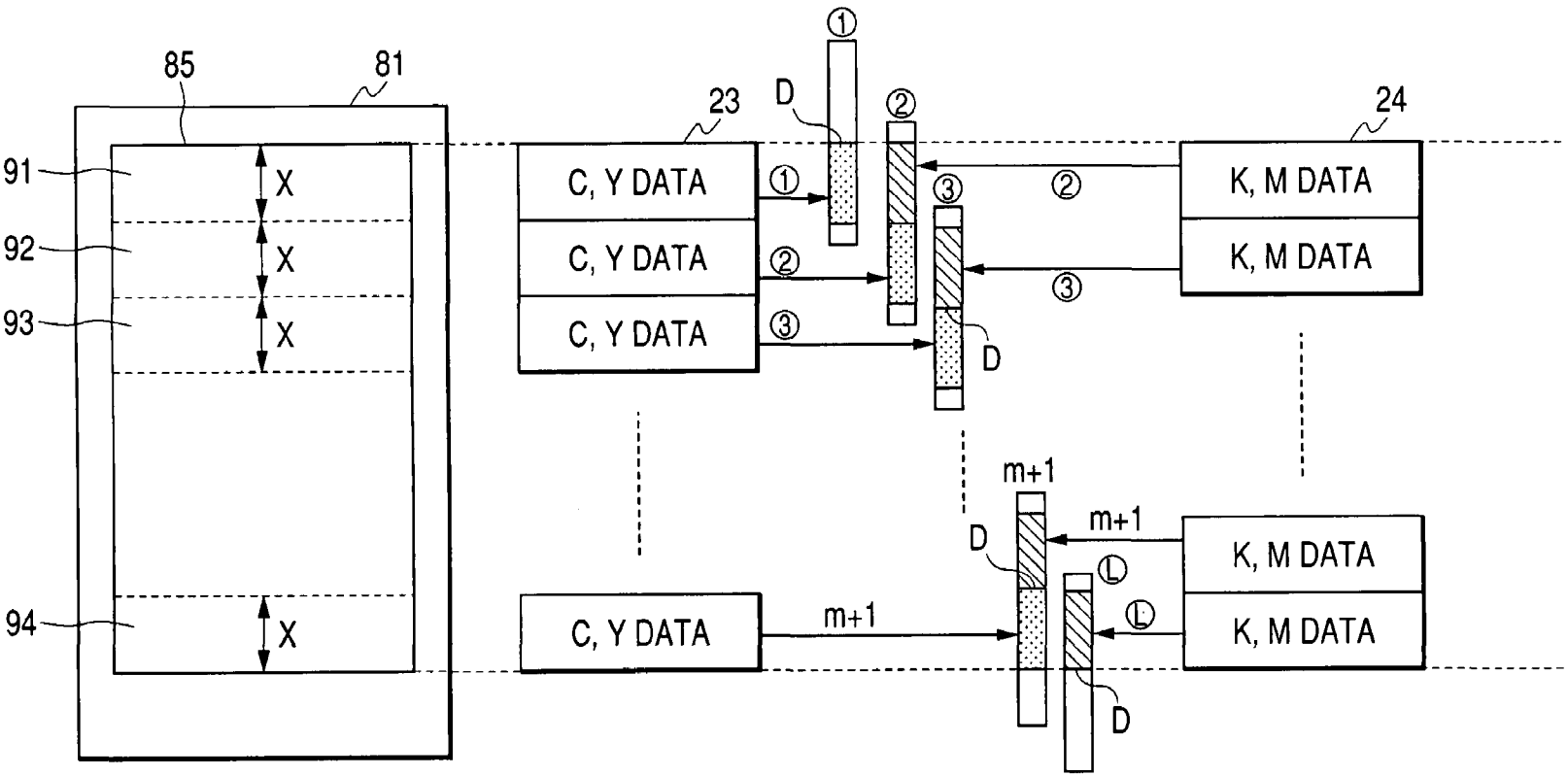
FIG. 10 shows a diagram for explaining color printing by print pass according to a second embodiment of the invention when one page printing is performed by the two-step print head.

With reference to FIG. 10, a print control method according to the second embodiment of the invention will be described. FIG. 10 is a diagram for explaining color printing by the print pass according to the second embodiment of the invention when one page is printed by the two-step print head. Basically this color printing is similar to that in FIG. 3. However, the second embodiment is different from the first embodiment in that the longitudinal width of each print pass is assigned so as to become uniform for all the print passes in one page. Therefore, all the printing elements Pe of each color are not used for printing but the printing elements of X-number corresponding to a greatest common divisor by which printing of one page can be divided uniformly are used for printing. Each printing element of the upper and lower steps of the print head is used on the basis of the divided position D. Accordingly, on the basis of the divided position D, printing is started and the print pass of uniform width is repeated, whereby one page printing ends in a state where the divided position D is arranged at a boundary of each page.

Figure 11:
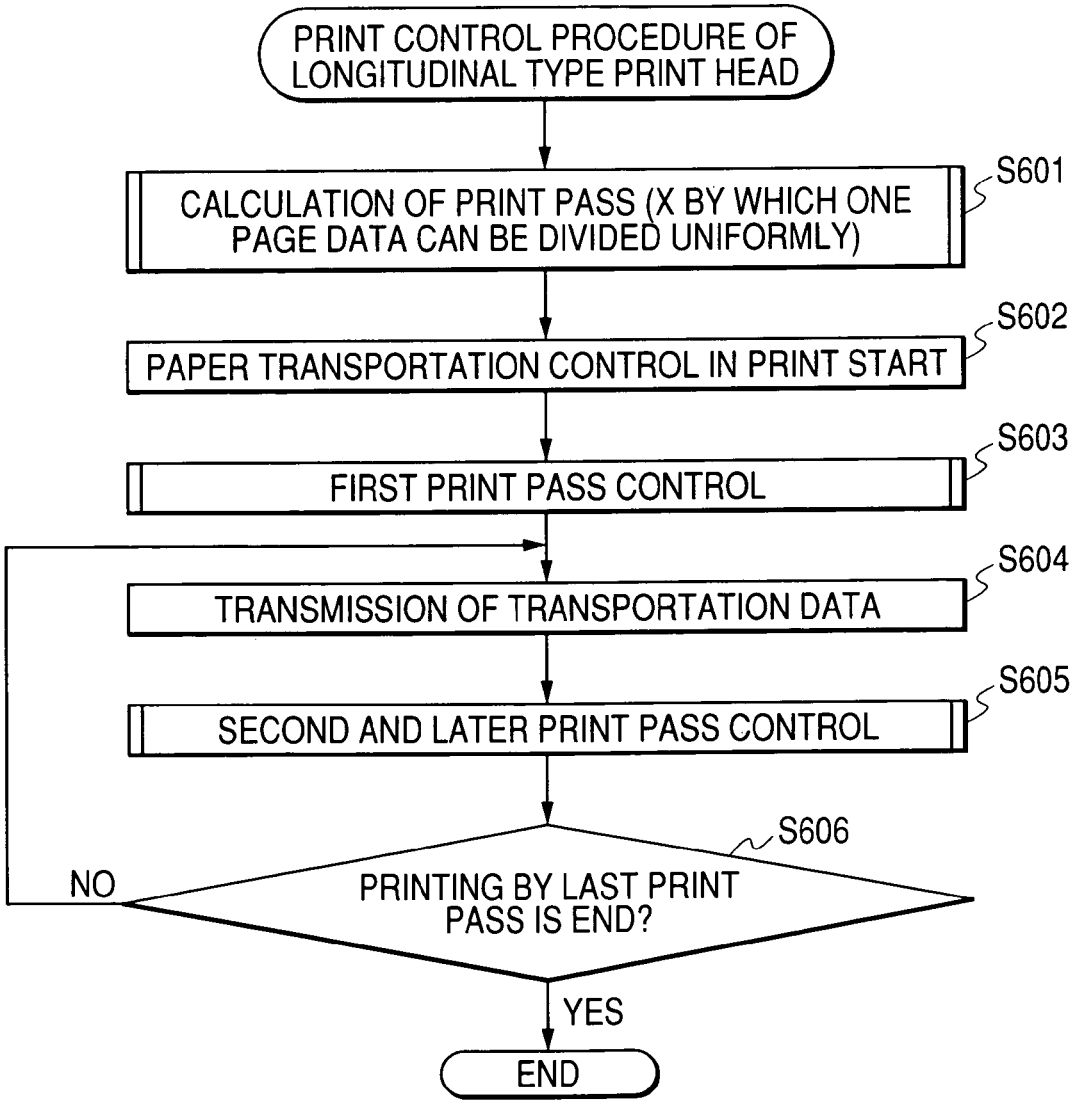
FIG. 11 shows a flowchart of control procedure of the two-step print head according to the second embodiment of the invention.

FIG. 11 shows a flowchart of a print control procedure of the two-step print head according to the second embodiment of the invention. First, a greatest common divisor (dot number: X) which is smaller than the number of the printing elements (Pe) and by which one page print data can be divided uniformly is calculated (S601). The greatest common divisor represents the greatest number of the printing elements which makes printing of one page possible by repeating a print pass of the same width (height). Next, in order to match the position of the lower-step print element of the two-step print head 70 with a print starting position, the printing paper is transported to the divided position D of the two-step print head 70 (S602). Control for executing the first print pass is performed (S603).

When the first print pass ends, in order to execute the second print pass, the printing paper is transported by the distance corresponding to the dot number X calculated in the calculation step of print pass (S604). Thereafter, control for executing the second print pass is performed (S605). In this step S605, print data of each color of X-width dots corresponding to the upper-step and lower-step printing elements is extracted and output. When the second print pass ends, whether all the print passes have ended is confirmed (S606). Since the total print pass number is found by the print pass calculation in step S601, by counting the print pass number every time the procedure passes through the confirmation step S606, whether the procedure proceeds to the last print pass can be judged. As described above, in the second embodiment, since printing of the entire one page can end by the uniform width print pass, unlike the first embodiment special processing for the last print pass is not required.

(Calculation of Uniform Width Print Pass)

Figure 12:
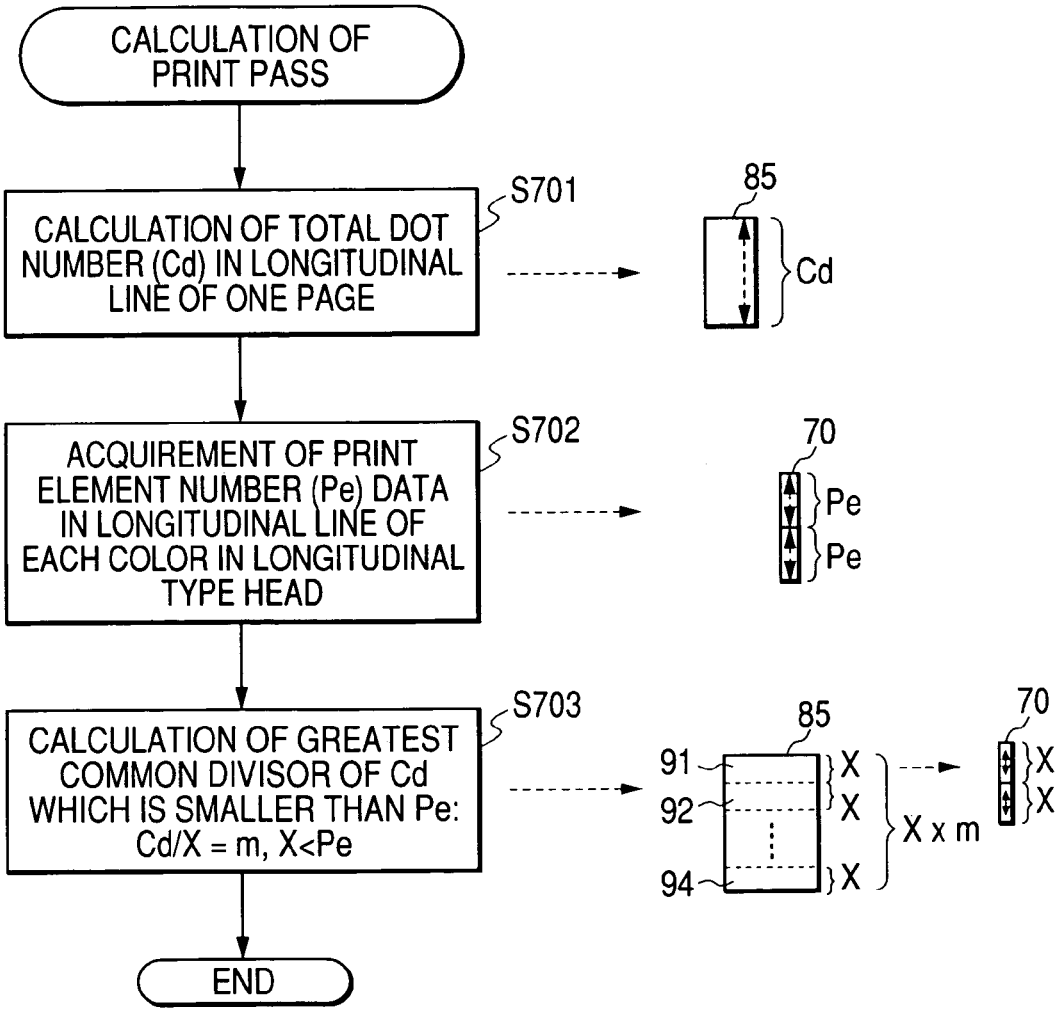
FIG. 12 shows a flowchart showing calculation of print pass in the second embodiment of the invention.

With reference to FIG. 12, calculation of the print pass in the second embodiment will be described.

First, the total dot number (Cd) in a longitudinal line of one page is calculated from a longitudinal length of a page 85 (S701). Next, print element data including the number Pe of the printing elements of each color (in upper-step and lower-step) in the two-step print head 70 is acquired (S702). The number (Pe) of these print elements and print resolution are determined according to the kind of the two-step print head 70, and stored in a printing apparatus or a print control device.

Next, from the read-out total dot number (Cd) and the print head resolution, a greatest-common divisor X that is smaller than the printing element number (Pe) is calculated (S703). In FIG. 12, the expression in case that the resolution of the print data is the same as the resolution of the print head 70, $Cd/X=m$, $X<Pe$ is shown. On the right side of its expression, the width of the print pass corresponding to the calculation result, and the printing elements used for printing by the print head 70 are shown. Here, reference character X represents the number of dots printable by one print pass, and reference character m represents the number of the print passes necessary to print one page. Since X is the greatest common divisor of Cd, a remainder is not produced. When the resolution of the print data is different from the resolution of the two-step print head 70, the predetermined correction is made according to the mutual resolution.

(Control of First Print Pass)

Figure 13:
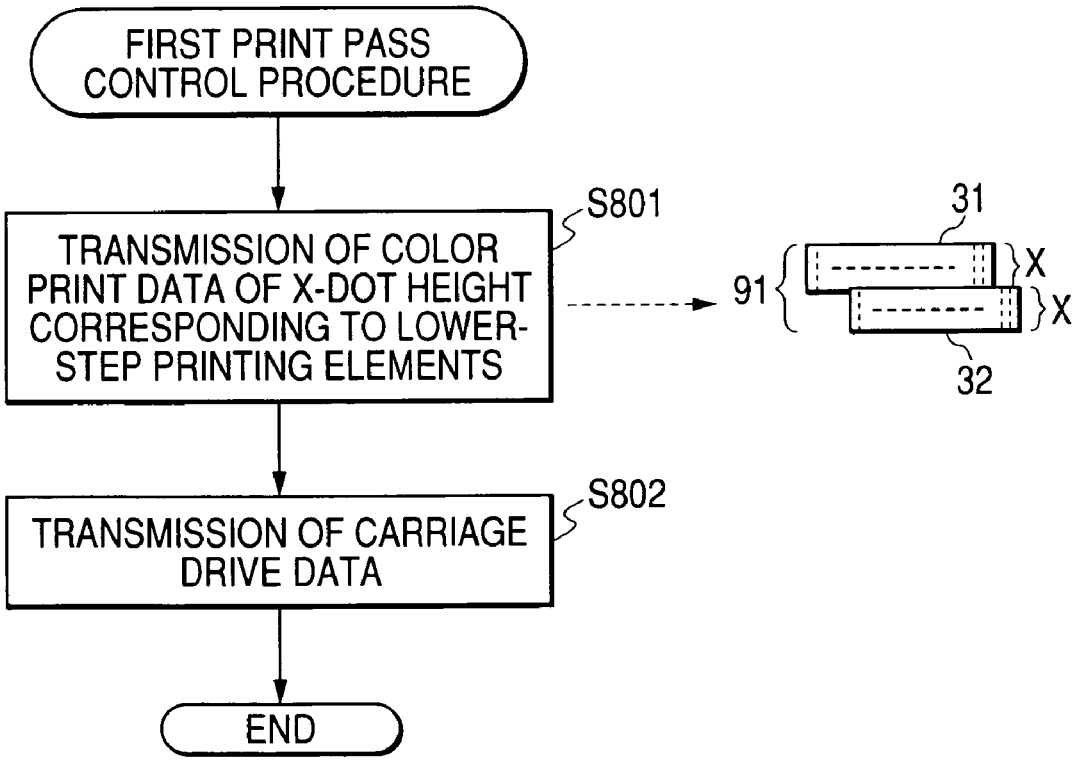
FIG. 13 shows a flowchart showing control procedure of a first print pass according to the second embodiment of the invention.

With reference to FIG. 13, the control procedure of the first print pass will be described. In the first print pass, printing is executed by the lower-step printing elements. Therefore, X-dot print data of each color corresponding to the lower-step print elements is extracted and transmitted to the printing apparatus 20 (S801). The print data corresponding to the first print pass, which have been transmitted to the printing apparatus 20, are stored respectively in the print buffers 31 and 32. The stored print data are printed in order in synchronization with the transverse movement of the carriage. Carriage drive data is transmitted (S802), and the drive of the carriage is controlled.

(Control Procedure of Second and Later Print Passes)

Figure 14:
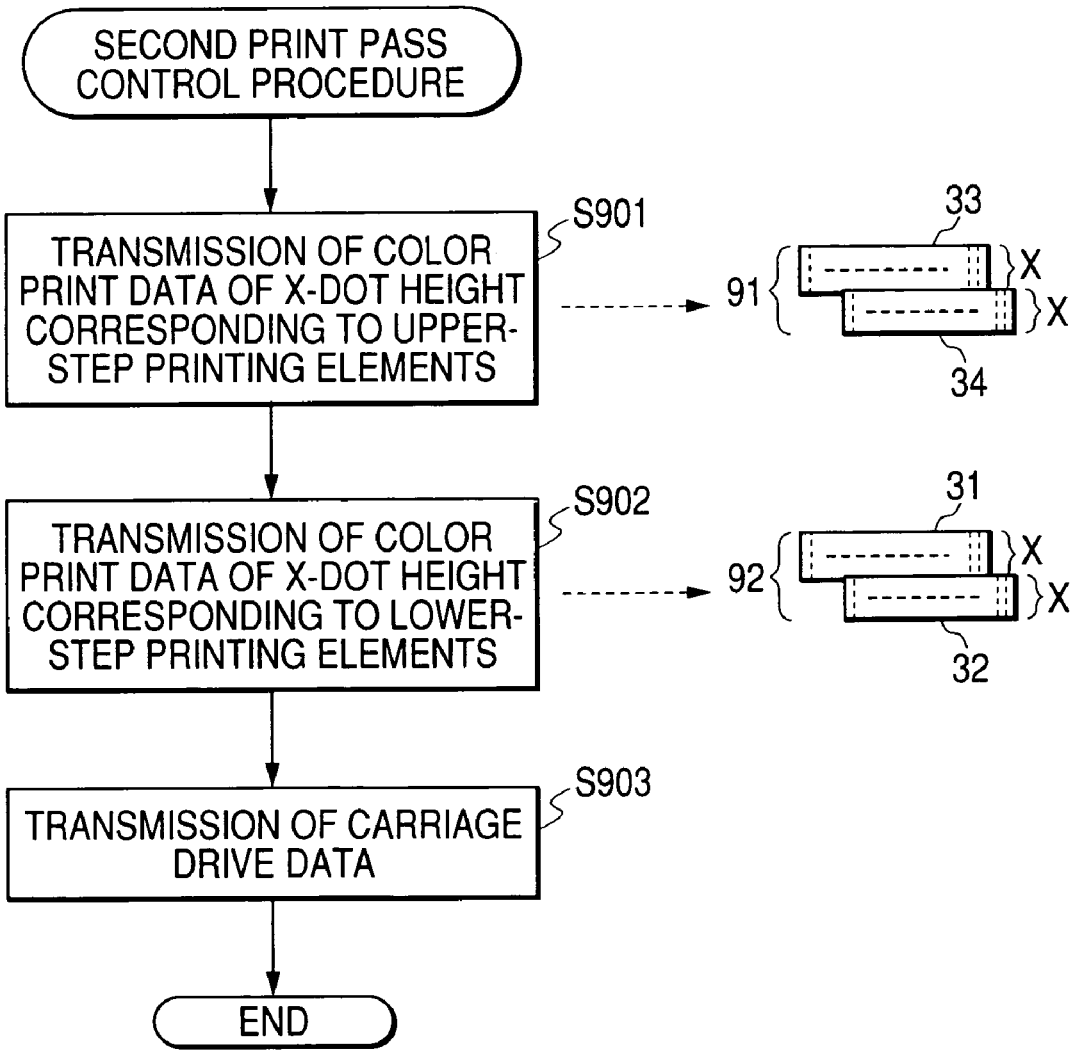
FIG. 14 shows a flowchart showing control procedure of second and later print passes according to the second embodiment of the invention.
Figure 15B:
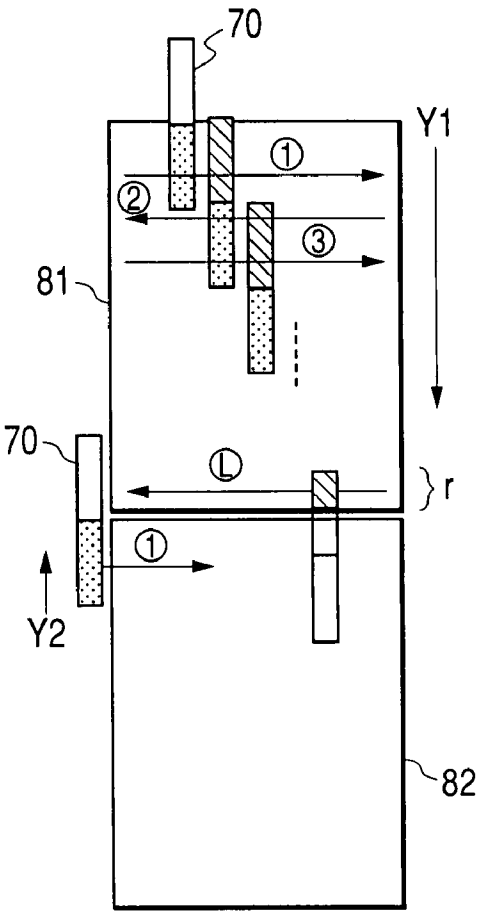
FIG. 15B is a diagram showing a color printing method by the two-step print head in a related art.
Figure 15A:
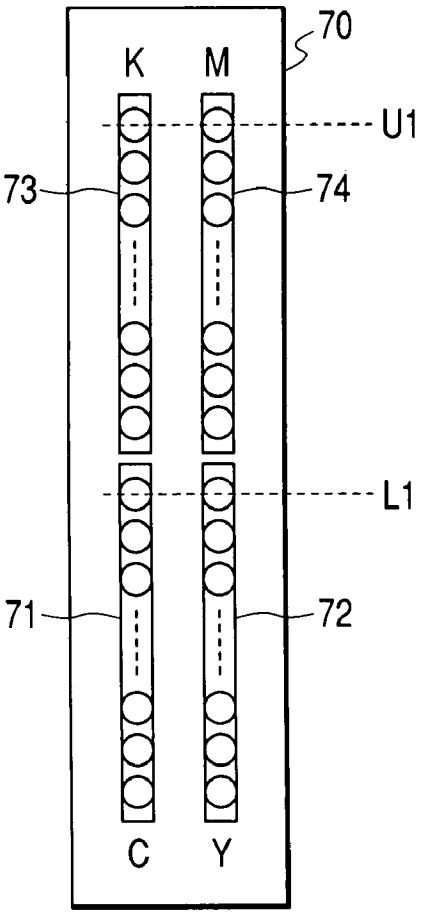
FIG. 15A is a diagram showing an example of an ejection nozzle surface of the two-step print head.

FIG. 14 shows a control procedure of second and later print passes. In the second print pass, printing is performed by the upper-step printing elements and the lower-step printing elements of the print head. Therefore, first, the print data by the upper-step printing element is transmitted (S901). The second print pass becomes the first print pass for the upper step printing element. The print data to be transmitted for the upper-step printing element are K-color print data and M-color print data corresponding to the upper-step printing elements of the print data printed by the lower-step printing elements in the first print pass. These print data are stored respectively into the print buffers 33 and 34, and printing is performed in synchronization with the transverse movement of the carriage by the printing elements of X-number from the downside of the upper-step printing elements of the two-step print head.

In the second print pass, the lower-step printing elements also perform printing simultaneously. Therefore, the print data for C-color and Y-color corresponding to the colors of the lower-step printing elements in the next print data are transmitted to the printing apparatus 20 (S902). The transmitted C-color print data and Y-color print data are stored respectively into the print buffers 31 and 32, and printed by the lower-step printing elements in synchronization with the movement of the carriage. Regarding transmission of the print data corresponding to the upper-step printing elements and the lower-step printing elements, it is not necessary to first transmit the upper-step printing element data, but the lower-step printing element data may be transmitted first. Further, according to necessity, carriage drive control is performed by transmission of the carriage drive data (S903).

Also in the second embodiment, when the last print pass of the print page ends, the divided position D of the two-step print head 70 is located in a print starting position of the next page or on the upper side of the next print starting position. Accordingly, in order to print the next page by the lower-step printing elements, when printing of the new page is started unlike the related art, it is not necessary to transport the printing paper in the reverse direction. Further, in the second embodiment of the invention, the width of the print pass is set to a height by which one page can be assigned uniformly, whereby it is not necessary to execute any special processing in the last print pass. Still further, since the print pass of uniform width is repeated, interlaced type printing is possible, so that high print quality can be obtained.

In the second embodiment, the value calculated as the greatest common divisor becomes frequently smaller than the number Pe of the printing elements of the two-step print head. As the number of the printing elements used in one print pass becomes smaller, the number m of the print passes necessary to print one page becomes greater. Namely, though the number of the printing elements used in all the passes is constant, there are printing elements that are not used at all. Therefore, in a case of a long page, compared with the case in the first embodiment, the necessary pass number increases and the print speed lowers. For example, when a page length is 3375 dots, when the number of the nozzles is 32, the number of the print passes is 105 with a remainder of 15 dots. With uniform assignment, 3375=27 nozzles×125 passes. Namely, it takes 20 additional passes. On the other hand, in the first embodiment, since printing is performed using all the printing elements (Pe) of the two-step print head, the number of the print passes can be minimized, so that the print speed can be increased. The processing for the last print pass, however, becomes complicated. Therefore, it is desirable that both of the print pass calculation (S101) in the first embodiment and the print pass calculation (S601) in the second embodiment are performed to judge which control type is most efficient. Regarding this judgment, in consideration of a balance between the required print quality and print speed, either type can be selectively adopted.

In the above description, the two-step print head 70 has the nozzle group (printing elements) of one longitudinal array for each color. However, also when the two-step print head 70 has plural nozzle groups of two or more longitudinal arrays for each color, the invention can be applied to its head. Further, in the above two embodiments, by the print control device 70 provided separately from the printing apparatus 20, printing of the two-step print head is controlled. However, the print control sections similar to those in the first and second embodiment can be provided inside the printing apparatus. Further, in the printing apparatus 20, the methods according to both the first embodiment of the invention and the second embodiment can be adopted.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A print control device for controlling a printing apparatus which comprises a transporter operable to transport a printing medium in a first direction, and a printing head provided with a plurality of printing elements arrayed in the first direction and divided into a first group situating on one side of a boundary line extending in a second direction perpendicular to the first direction and a second group situating on the other side of the boundary line, the print control device comprising:

a data assignment controller, operable to assign print data, for printing on the printing medium to at least one of the printing elements included in each of the first group and the second group; and a transportation controller, operable to drive the transporter to control a transportation amount of the printing medium in accordance with a first number that is the number of printing elements to which the print data is assigned, wherein:

in a case where the first number is less than a second number that is the total number of the printing elements in each of the first group and the second group, the data assignment controller first assigns the print data to one of the printing elements which is closest to the boundary line for each of the first group and the second group, and then assigns the print data to one of the printing elements farther from the boundary line.

2. The print control device as set forth in claim 1, wherein the data assignment controller determines the first number as a number which is no greater than the second number but the greatest number by which a total pixel number of the printing medium in the first direction is uniformly divisible.

3. A method of controlling a printing apparatus which comprises a transporter operable to transport a printing medium in a first direction, and a printing head provided with a plurality of printing elements arrayed in the first direction and divided into a first group situating on one side of a boundary line extending in a second direction perpendicular to the first direction and a second group situating on the other side of the boundary line, the method comprising:

assigning print data, for printing on the printing medium, to at least one of the printing elements included in each of the first group and the second group; and driving the transporter to control a transportation amount of the printing medium in accordance with a first number that is the number of printing elements to which the print data is assigned, wherein:

in a case where the first number is less than a second number that is the total number of the printing elements in each of the first group and the second group, the print data is first assigned to one of the printing elements which is closest to the boundary line for each of the first group and the second group, and is then assigned to one of the printing elements which is farther from the boundary line.

4. The method as set forth in claim 3, further comprising determining the first number as a number which is no greater than the second number but the greatest number by which a total pixel number of the printing medium in the first direction is uniformly divisible.

5. A program product comprising a recording medium having recorded a program causing a computer to execute the method as set forth in claim 3.

* * * * *